US005841337A

United States Patent [19]

Douglass

[11] Patent Number: 5,841,337

[45] Date of Patent: Nov. 24, 1998

[54] TOUCH SAFE FUSE MODULE AND HOLDER

[75] Inventor: Robert Stephen Douglass, Wildwood, Mo.

[73] Assignee: Cooper Technologies Company, Houston, Tex.

[21] Appl. No.: 784,389

[22] Filed: Jan. 17, 1997

[51] Int. Cl.[6] ..... H01H 85/22; H01H 85/02; H01H 85/48; H01H 85/20

[52] U.S. Cl. ..... 337/198; 337/186; 337/197; 337/194; 337/159; 337/161; 337/162; 361/104; 361/833; 361/835

[58] Field of Search ..... 337/186, 198, 337/197, 260, 264, 255, 227, 268, 269, 271, 290, 295, 262, 241, 251, 216, 208, 163, 265, 168, 179, 192, 206, 211, 213, 222; 361/104, 833–835

[56] References Cited

U.S. PATENT DOCUMENTS

| | | | |
|---|---|---|---|
| 2,091,204 | 8/1937 | Horn . | |
| 3,189,712 | 6/1965 | Kozacka . | |
| 3,202,788 | 8/1965 | George . | |
| 3,229,066 | 1/1966 | Rowe . | |
| 3,261,950 | 7/1966 | Kozacka . | |
| 3,261,952 | 7/1966 | Kozacka . | |
| 3,671,910 | 6/1972 | Kozacka . | |
| 3,697,916 | 10/1972 | Belcher et al. . | |
| 3,713,064 | 1/1973 | Jacobs, Jr. . | |
| 3,732,516 | 5/1973 | Puetz . | |
| 3,764,949 | 10/1973 | Swain . | |
| 3,766,507 | 10/1973 | Jacobs, Jr. . | |
| 3,783,428 | 1/1974 | Swain et al. . | |
| 3,824,520 | 7/1974 | Knapp, Jr. . | |
| 3,935,553 | 1/1976 | Kozacka et al. . | |
| 4,082,408 | 4/1978 | Angelis . | |
| 4,164,726 | 8/1979 | Weibe | 337/215 |
| 4,300,281 | 11/1981 | Panaro . | |
| 4,308,516 | 12/1981 | Shimada et al. | 337/241 |
| 4,344,058 | 8/1982 | Knapp, Jr. et al. . | |
| 4,365,226 | 12/1982 | Barry et al. . | |
| 4,414,526 | 11/1983 | Panaro . | |
| 4,559,504 | 12/1985 | Kree . | |
| 4,751,489 | 6/1988 | Spaunhorst . | |
| 4,782,317 | 11/1988 | Thwaites . | |
| 4,949,062 | 8/1990 | Mollet . | |
| 4,949,063 | 8/1990 | Levko . | |
| 4,951,026 | 8/1990 | Ehlmann . | |
| 4,972,170 | 11/1990 | Ehlmann et al. . | |
| 4,992,770 | 2/1991 | Spalding et al. . | |
| 4,994,779 | 2/1991 | Douglass . | |
| 5,002,505 | 3/1991 | Jones et al. . | |
| 5,075,664 | 12/1991 | Spalding et al. . | |
| 5,077,534 | 12/1991 | Douglass . | |
| 5,150,093 | 9/1992 | Gurevich | 337/163 |
| 5,229,739 | 7/1993 | Oh et al. . | |
| 5,235,306 | 8/1993 | Kalra et al. . | |
| 5,239,291 | 8/1993 | Henricks et al. . | |
| 5,296,832 | 3/1994 | Perreault et al. . | |
| 5,345,211 | 9/1994 | Muramatsu et al. | 337/186 |
| 5,357,234 | 10/1994 | Pimpis et al. . | |
| 5,406,244 | 4/1995 | Thwaites et al. | 337/163 |
| 5,418,515 | 5/1995 | Reyes . | |
| 5,426,411 | 6/1995 | Pimpis et al. . | |

FOREIGN PATENT DOCUMENTS

| | | |
|---|---|---|
| 680901 | 10/1952 | United Kingdom . |

*Primary Examiner*—Leo P. Picard
*Assistant Examiner*—Anatoly Vortman
*Attorney, Agent, or Firm*—Burns, Doane, Swcker & Mathis LLP

[57] ABSTRACT

A safety fuse system includes a safety fuse including a fuse casing having a bottom surface and opposing end surfaces at each end of the bottom surface; a fuse element inside the fuse casing; a pair of electrical contacts connected to the fuse element, the electrical contacts extending through openings in the bottom surface of the fuse casing to an exterior of the fuse casing; the openings being located at a distance from the opposing end surfaces so that the electrical contacts are remote from the opposing ends; a fuse holder including a fuse holder casing having a top surface, the top surface including apertures for receiving the electrical contacts of the safety fuse, the apertures being in alignment with the safety fuse openings when the safety fuse is engaged with the fuse holder; metal contacts within the fuse holder casing for receiving the electrical contacts.

22 Claims, 7 Drawing Sheets

TOUCH SAFE FUSE MODULE AND HOLDER

BACKGROUND OF THE INVENTION

1. Field of the Invention

The present invention relates to a touch safe fuse and a holder therefor.

2. Description of Related Art

Traditional fuse protection systems employ cylindrical cartridge fuses having cylindrical contact areas at each end thereof that are engaged to metal clips on a corresponding fuse holder. The contacts and fuse clips generally provide exposed metal surfaces that constitute an electrical safety hazard. Specifically, the contacts and fuse clips are traditionally exposed and thus subject to being accidentally touched by humans or may enable a short circuit to be inadvertently created if a metal piece contacts two adjacent surfaces.

FIGS. 9–14 illustrate two different embodiments of the prior art fuses and fuse holders. FIG. 10 illustrates a conventional fuse 2 having a fuse body covered with an insulating material 4. At each end of the fuse 2 are cylindrical metallic contacts 6 for contacting fuse clips. FIG. 9 illustrates a fuse holder having metallic fuse clips and wiring lugs 8. The fuse clips 8 are separated by plastic barriers 10 on the base 12 of the fuse holder.

FIGS. 12–14 illustrate a different prior art fuse and fuse holder. According to FIG. 13, a prior art fuse 14 includes a main body having an insulating surface 16. Cylindrical metal contacts 18 are arranged at each end of the fuse 14.

The fuse holder 20, illustrated in FIGS. 12 and 14, includes metal fuse clips and wiring lugs 22, which are separated by plastic barriers 24.

In addition to the safety hazard discussed above, the cylindrical contacts 6, 18 of the prior art fuses make poor electrical contact with the fuse clips 8, 22. Although the fuse contacts and fuse clips may look suitable for making an ideal electrical contact, in reality, they tend to be warped and/or tapered. Thus, as a result, they create anything but an ideal electrical contact. In reality, they essentially create a series of point contacts. It has been estimated that only about one percent of the available surface area between the fuse contacts and the fuse clips are actually in secure electrical contact. The unsuitable contact creates thermodynamic problems, as well as electrical problems.

In addition to the poor contact between the traditional fuse and the fuse clips, the concept of a cylindrical fuse is an inefficient use of space. Although the traditional fuses are cylindrical, they inevitably occupy rectangular spaces in any installation. See FIG. 15 of the present application. The rectangular space requirement is driven by existing standards for round fuse holders and the spacing requirements for multiple fuse installations for fused equipment.

In addition to the poor electrical contact and inefficient space utilization, the traditional cylindrical fuse system typically does not offer an adequate fuse indicator to indicate when the fuse is open. Thus, to determine if a fuse is open, the fuse must typically be removed from the fuse holder and tested with equipment, thus creating additional safety hazards.

The prior art fuses utilize several different mechanism for determining if a fuse was blown. Such mechanisms include a spring loaded mechanism for triggering a spring that moves a plunger to a more visible location when the fuse is blown, an LED in a parallel circuit that will illuminate when the fuse is blown, and a temperature sensing chemical located on the fuse element that is expelled when the fuse element overheats. Such mechanisms are either too expensive or ineffective to be satisfactory.

OBJECTS AND SUMMARY

An object of the present invention is to provide a safety fuse and holder therefor that is safe to touch.

Another object of the present invention is to provide a fuse that makes good electrical contact with a fuse holder.

It is yet another object of the present invention to provide a fuse system that utilizes space efficiently.

It is still yet another object of the present invention to provide a fuse system that provides a convenient indicator to determine whether or not the fuse is open.

The foregoing objects of the present invention are effected by providing a safety fuse system that includes a safety fuse including a fuse casing having a bottom surface and opposing end surfaces at each end of the bottom surface; a fuse element inside the fuse casing; a pair of electrical contacts connected to the fuse element, the electrical contacts extending through openings in the bottom surface of the fuse casing to an exterior of the fuse casing; the openings being located at a distance from the opposing end surfaces so that the electrical contacts are remote from the opposing ends. The system further includes a fuse holder including a fuse holder casing having a top surface, the top surface including apertures for receiving the electrical contacts of the safety fuse, the apertures being in alignment with the safety fuse openings when the safety fuse is engaged with the fuse holder; metal contacts within the fuse holder casing for receiving the electrical contacts.

The system may also include a light tube extending into the fuse module with a heat sensitive material at the inner end of the light tube. When the fuse is blown, the heat sensitive material will change color and will be easily viewed from outside the fuse module by means of the light tube.

DETAILED DESCRIPTION OF THE PREFERRED EMBODIMENTS

Figure 1:
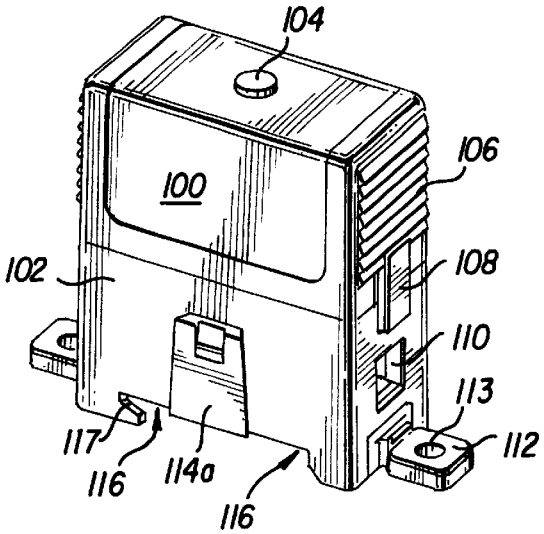
FIG. 1 is a perspective view of a fuse and fuse holder according to the present invention.
Figure 2:
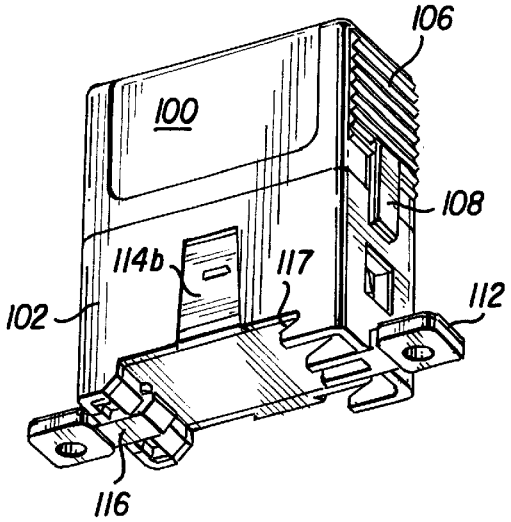
FIG. 2 is a different perspective view of the fuse and fuse holder of FIG. 1.
Figure 3:
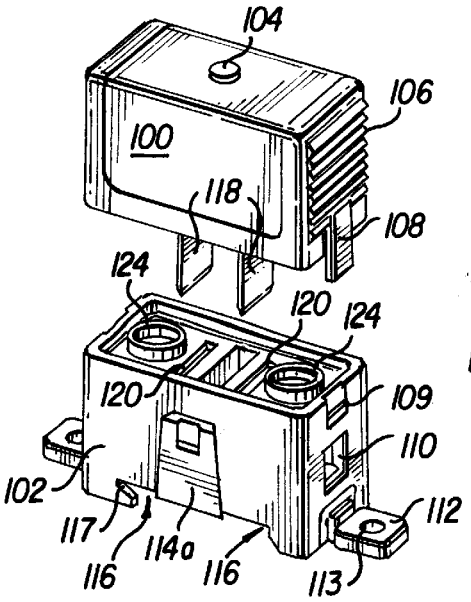
FIG. 3 is an exploded view of the fuse and fuse holder of FIG. 1.
Figure 4:
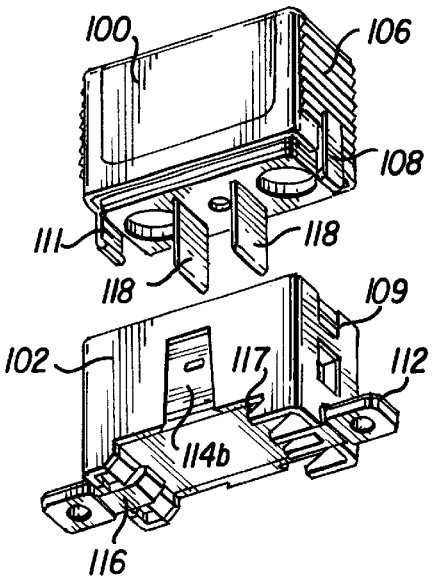
FIG. 4 is another exploded view of the fuse and fuse holder of FIG. 1.

FIGS. 1–4 illustrate a preferred embodiment of the present invention. A fuse module 100 is generally of a rectangular shape. The fuse module 100 is adapted to be mounted on a respective fuse holder 102. Gripping surfaces 106 at either end of the fuse module 100 facilitate grasping the fuse module 100 when disengaging the fuse module 100 from the fuse holder 102.

Each fuse module 100 has a pair of locking tabs 108 mounted at the ends thereof. The locking tabs 108 are intended to engage with matching recesses 109 on the fuse holder 102. As can be best seen in FIG. 4, ridges 111 on the locking tabs 108 engage in the recesses 109 to maintain the fuse module 100 in an engaged position with the fuse holder 102.

Each fuse holder 102 includes a dove tail connecting tab 114*a* on one side thereof and a matching dovetail slot 114*b* on an opposite side thereof. On one side of each fuse module, the dove tail tab 114*a* extends outwardly from the fuse holder 102 so as to engage with the opposite, matching dove tail slot 114*b* on the opposite side of an adjacent fuse holder 102.

In addition, each fuse holder 102 includes mounting bosses 112 which include apertures 113 extending therethrough. The mounting bosses 112 can be used to secure the fuse holder 102 to a surface. Alternatively, the fuse holders 102 may be mounted to a standard DIN rail through the use of DIN rail clips 116. Slots 117 at the base of the fuse holder 102 engage one side of the DIN rail, whereas the retractable DIN rail clips 116 can be extended and retracted so as to permit engagement and disengagement from the opposite side of the DIN rail.

Each fuse module 100 includes a pair of fuse blades 118 extending from a lower surface thereof. The fuse blades 118 are arranged to fit through blade slots 120 in the corresponding fuse holder 102. In addition, openings 124 in the top surface of the fuse holder 102 provide access to the interior of the fuse holder 102 so that wiring connections can be made, as will be described later. The flat blades 118 provide a better electrical contact than the prior art round ferrules or contact surfaces of the cylindrical fuses.

On the end surfaces of each fuse holder 102 are wiring ports 110 to permit the insertion of wires to be mounted to the fuse holder 102.

Figure 5:
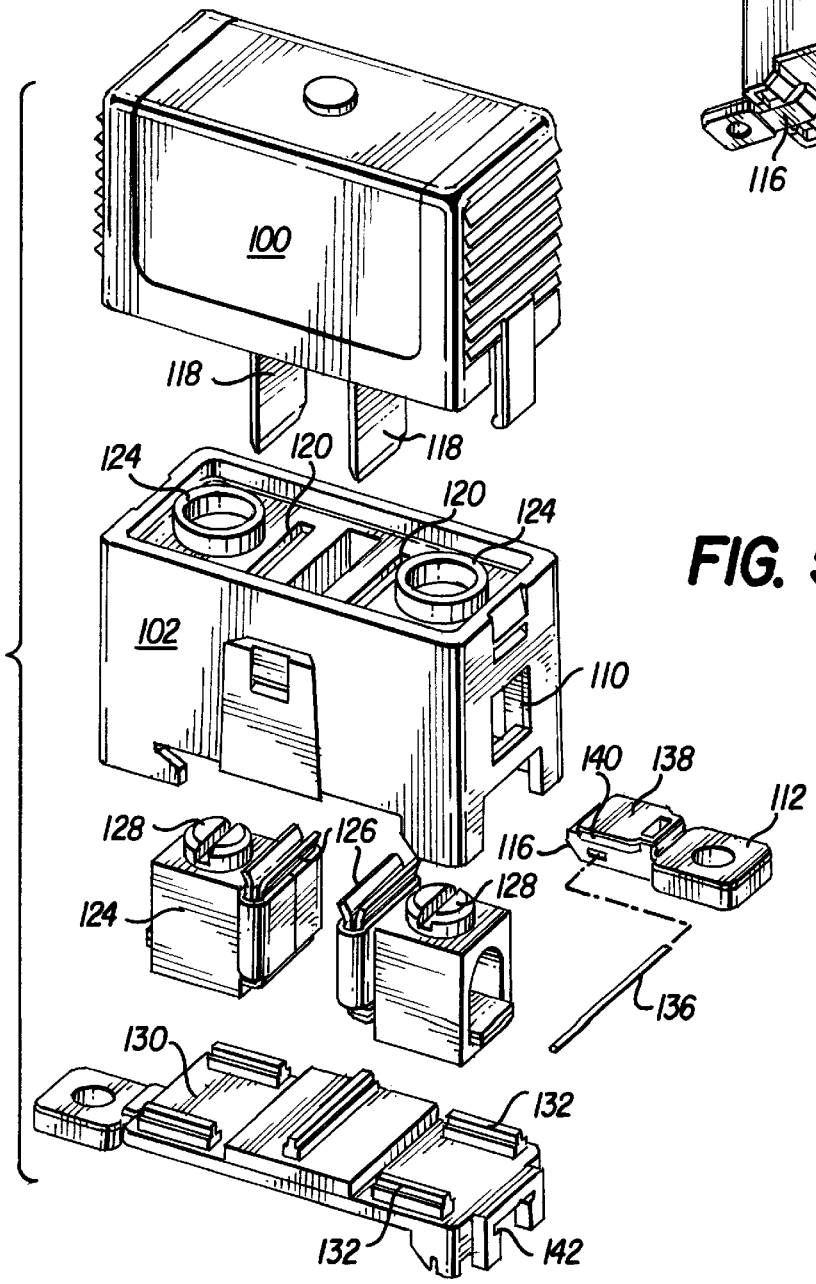
FIG. 5 is an exploded view of the fuse holder of FIG. 1.
Figure 6:
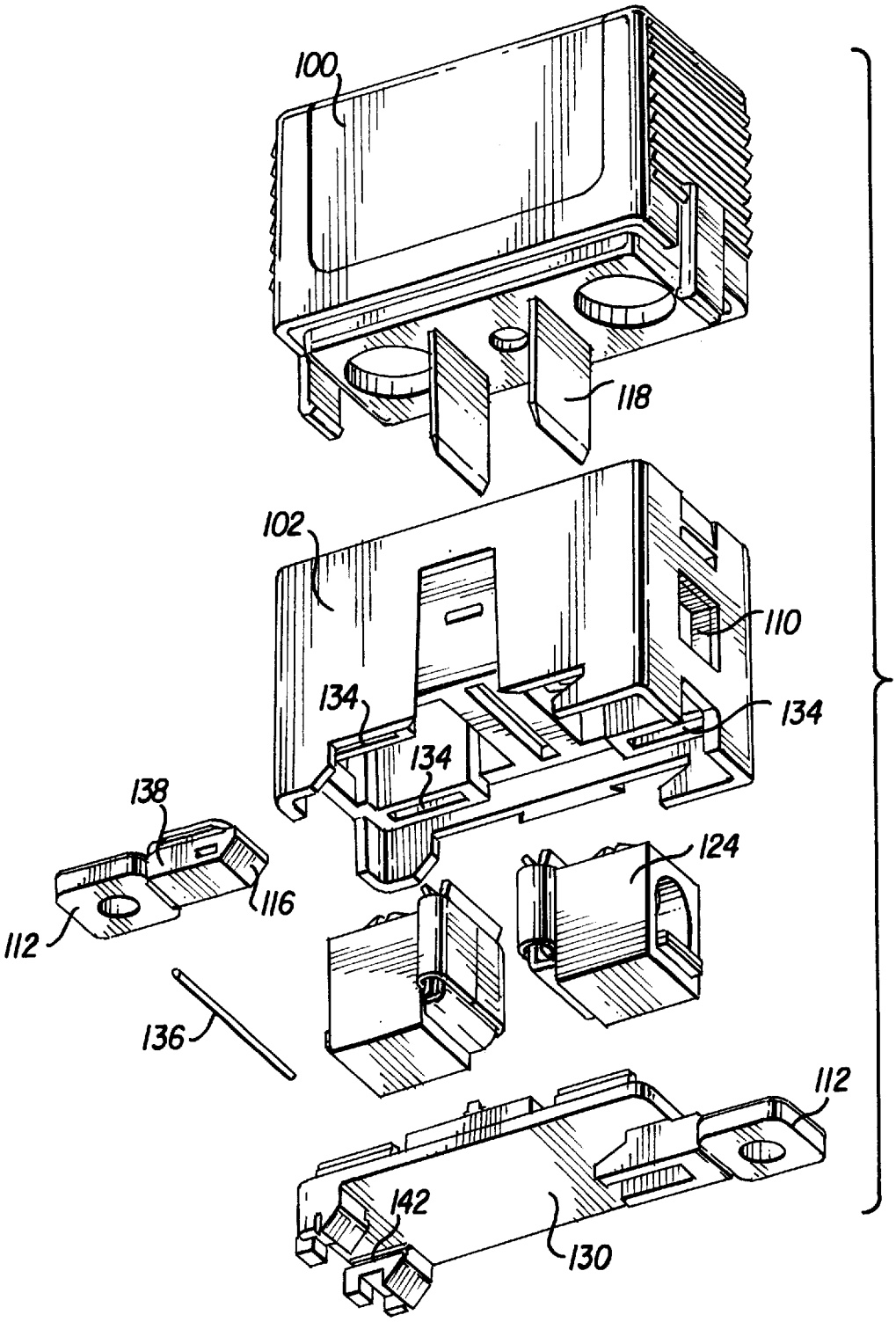
FIG. 6 is an exploded view of the fuse holder of FIG. 1.

FIGS. 5 and 6 illustrate exploded views of the fuse module 100 and the fuse holder 102, wherein the inside details of the fuse holder 102 are illustrated. The fuse holder 102 includes a base 130 upon which are fixed a pair of wiring lugs 124. Each wiring lug 124 includes fuse clips 126 for receiving the fuse blades 118 via the slots 120. Each lug 124 also includes a screw 128 for securing a wire to the lug 124. The wire to be secured by the screw 128 is inserted through the wiring port 110 on the ends of the fuse holder 102.

A screw driver may be inserted through the apertures 124 in order to loosen and tighten the screws 128, by means of a slot formed in the end of the screw.

Ridges 132 are secured on top of the fuse holder base 130. The ridges 132 engage in slots 134 in the fuse holder 102 so as to hold the base 130 to the remaining portion of the fuse holder 102.

On the underside of the fuse holder base 130 are slots 142 which receive tabs 140 extending laterally from a slide 138. At one end of the slide 138 is one of the bosses 112 for mounting the fuse holder 102. At the opposite end of the slide 138 is the DIN rail mount 116. A spring pin 136 extends through an opening in the slide 138 and engages with specially designed holes adjacent the slots 142 in the bottom of the fuse holder base 130. The spring pin 136 biases the slide 138 toward the center of the fuse holder 102, but provides sufficient flexibility so that the slide 138 can be withdrawn toward the outside of the fuse holder 102 in order to permit disengagement from a DIN rail.

Figure 7:
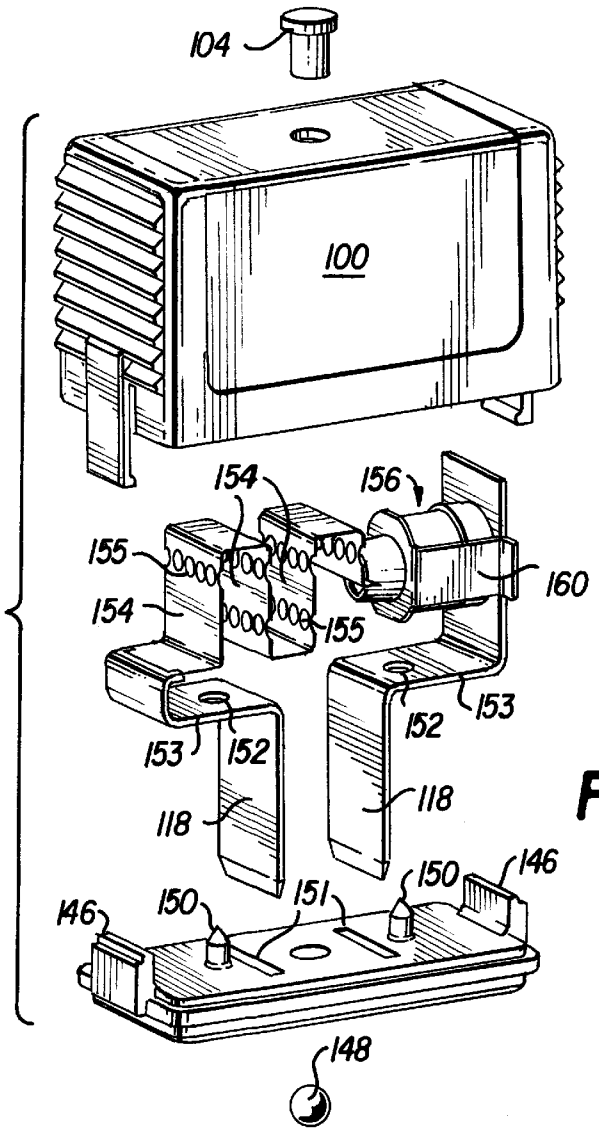
FIG. 7 is an exploded view of the fuse of FIG. 1.
Figure 9:
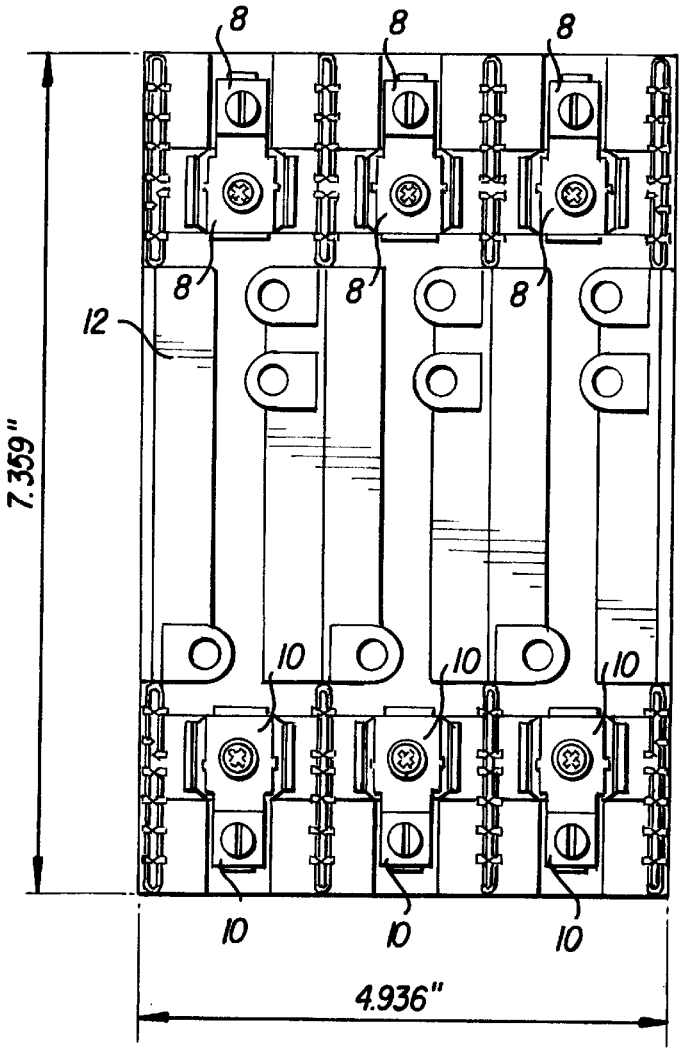
FIG. 9 (PRIOR ART)
FIGS. 9 and 11 are views of a prior art fuse holder.
Figure 10:
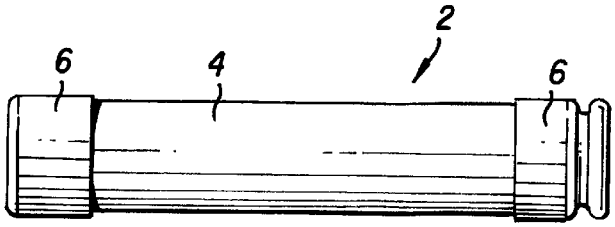
FIG. 10 (PRIOR ART
FIG. 10 is a side view of a prior art fuse.
Figure 11:
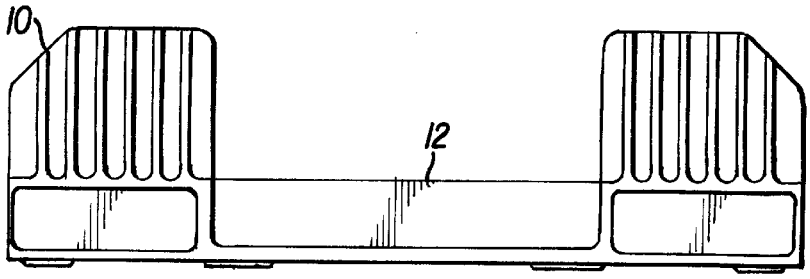
FIG. 11 (PRIOR ART)
Figure 12:
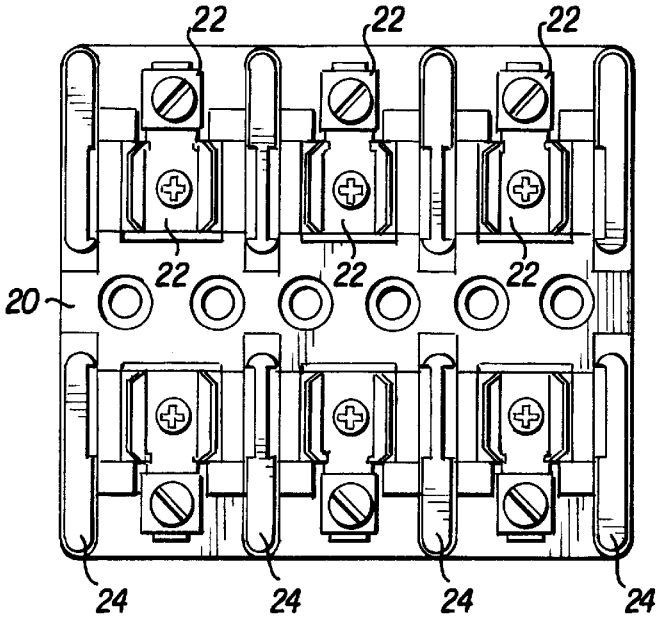
FIG. 12 (PRIOR ART)
FIGS. 12 and 14 are views of another prior art fuse holder.
Figure 13:
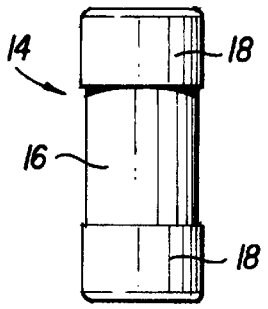
FIG. 13 (PRIOR ART)
FIG. 13 is a side view of another prior art fuse.
Figure 14:
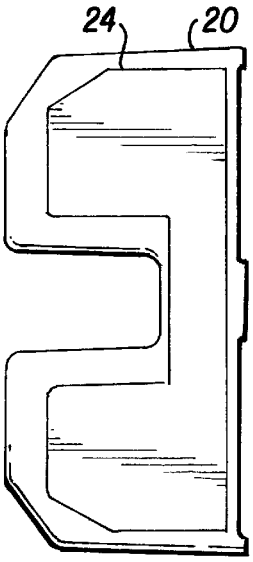
FIG. 14 (PRIOR ART)

FIG. 7 illustrates an exploded view of the fuse module 100. At the top of the fuse module 100 is a blown fuse indicator 104. The blown fuse indicator 104 provides an indication when the fuse has been interrupted.

At the bottom of the fuse module 100 is a base 144 that includes openings 151 for the blades 118 to extend therethrough. The base 144 also includes a pair of pins 150 that project inwardly into the fuse module 100 so as to engage with similarly sized apertures 152 in an upper extension 153 of each of the blades 118.

The base 144 further includes tabs 146 on each end thereof that engage with similarly shaped surfaces on the main body of the fuse module 100 so as to retain the base 144 to the module 100. The base 144 may be glued, welded, or otherwise secured to the fuse module 100 in a permanent manner.

Connected to one of the fuse blades 118, via the extension 153, is a short circuit interruption element 154, which includes a folded section of copper or copper alloy material. The material is perforated with a plurality of openings 155, which openings 155 create a plurality of parallel paths of narrow cross-section. The thickness of the copper material and the spacing of the openings 155 define the rating of the short circuit interruption element 154. The element 154 may be folded as illustrated in FIG. 7 in order to fit into a relatively small space.

Connected to the other of the blades 118, via the other extension 153, is an overload current interruption mechanism 156. The overload current interruption mechanism 156 can be better understood from FIG. 8, which illustrates a cross-sectional view taken through the fuse module 100.

The overload current interruption mechanism 156 includes a conductive trigger 164 that is soldered to one end of the short circuit interruption element 154 with a deposit of solder 158. A heat absorbing electrically conductive element 160 fits over the trigger 164 and is connected thereto with solder 158. A casing 168 receives one end of the trigger 164 and a spring 162 which provides a biasing force between the casing 168 and the trigger 164 so as to urge the trigger 164 away from the short circuit interruption element 154. As best seen in FIG. 7, the conductive element 160 extends longitudinally along the casing 168 and forms an electrical connection with an extension 153 of the blade 118. An insulator 166 provides electrical insulation between the casing 168 and the upper extension 153 of the blade 118.

When the fuse is subjected to a short circuit, which provides a high level of power in a short burst, the short circuit interruption element 154 will melt, thus opening the fuse.

When the fuse is subjected to an overload current, the solder 158 in the overload current interruption mechanism 156 will absorb heat, thus melting the solder 158. When the solder 158 melts, the trigger 164 is released from either the element 160 or the short circuit interruption element 154, and the spring 162 urges the trigger 164 toward the edge of the fuse module 100, away from the short circuit interruption element 154. As the trigger 164 moves in that direction, the circuit between the short circuit interruption element 154 and the element 160 is interrupted. Accordingly, the overload current interruption mechanism 156 provides a time delay fuse for an overload situation.

Heat absorbing material, such as quartz sand 170 may be filled within the fuse module 100 and sealed with a ball or plug 148. The quartz sand 170 provides better heat absorption for timed delay and cycling capability with regard to the overload current interruption mechanism 156, and better arc quenching capability for the short circuit interruption element 154.

The overload current interruption mechanism 156 may be calibrated by selection of the solder 158 which melts at a preferred temperature.

Figure 15:
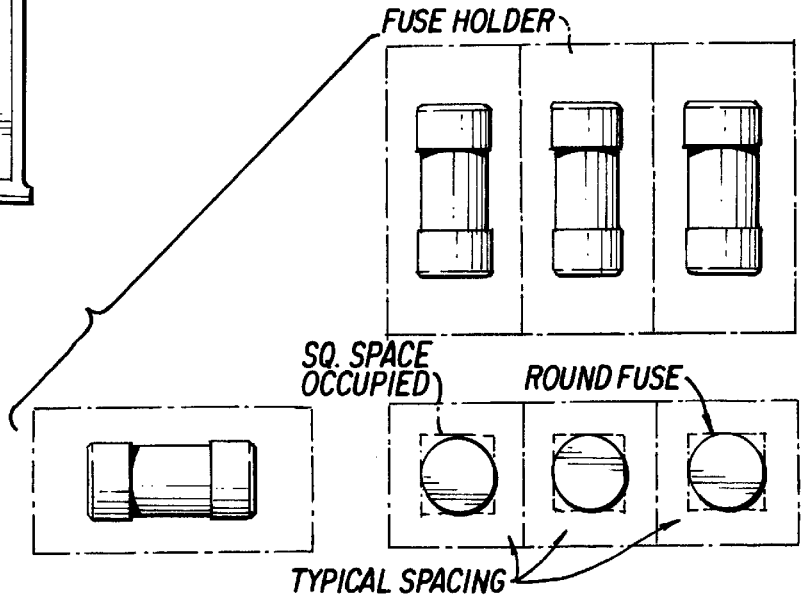
FIG. 15 is a schematic illustration illustrating the space inefficiency of a cylindrical fuse.

In view of the configuration of the fuse module 100, and the rectangular casing therefor, the fuse according to the present invention is more compact than the prior art cylindrical fuses. Turning attention to FIG. 15, side, end, and front views of a prior art cylindrical fuse system are shown illustrating how the cylindrical fuse is not as space efficient as a rectangular fuse would be.

Figure 16:
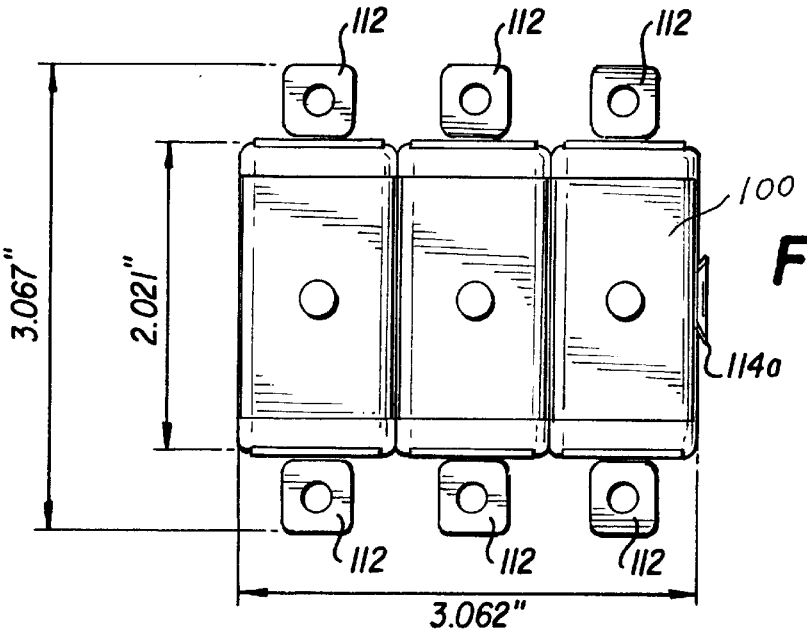
FIG. 16 is a top view of a plurality of fuses and fuse holders according to the present invention.
Figure 17:
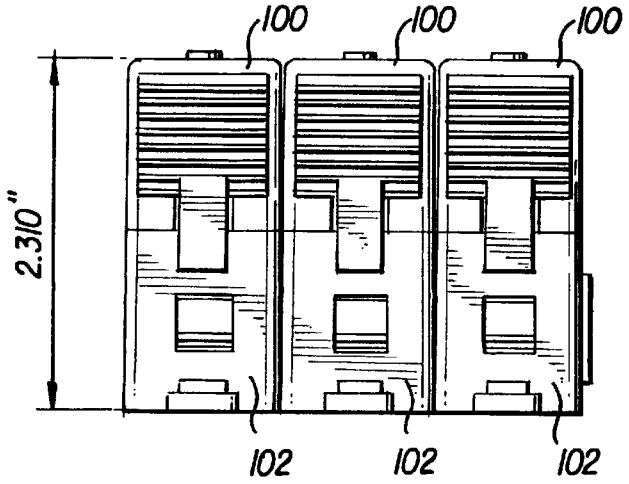
FIG. 17 is a side view of a plurality of fuses and fuse holders according to the present invention.
Figure 18:
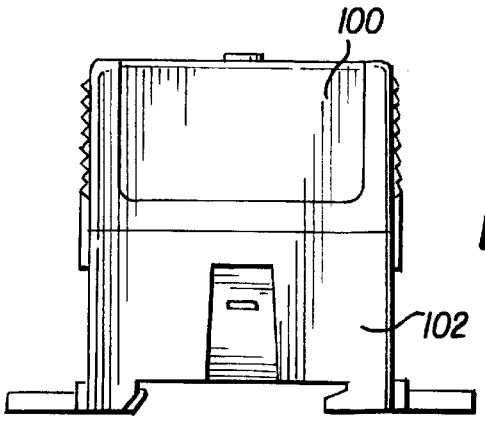
FIG. 18 is a side view of a fuse and fuse holder according to the present invention.

FIG. 16 is a top plan view of three fuse modules 100 which are mounted on fuse holders 102, and wherein the fuse holders 102 are connected together by the dove tails 114*a,* 114*b*. FIG. 17 is an end view of the three units illustrated in FIG. 16. FIG. 18 is a side view illustrating the group of fuses 100 and fuse holders 102. FIGS. 16–18 provide dimensions (in inches) to give an idea of the compact nature of the fuse 100 and fuse holder 102 according to the present invention. Of course, the present invention may be embodied in sizes other than those illustrated in FIGS. 16–18.

In one embodiment of the present invention, the fuse blades 118 are connected to the fusible elements 154, 156 via lateral extensions 153. A significance of the lateral extensions 153 is that the fuse blades 118 are located toward the center of the fuse module 100. Accordingly, when an operator is handling the fuse module 100, it is very unlikely that the fingers of the operator will extend over far enough in order to make contact with the fuse blades 118 because the fuse blades 118 are so close to the center of the fuse module 100. Thus, the lateral extension 153 enhance the safety of the present invention.

Although the embodiment disclosed above includes both a short circuit interruption element and an overload current interruption mechanism, it is not necessary for both functions to be incorporated into a particular fuse. A fuse may be made with either only the short circuit interruption element or only the overload current interruption mechanism.

The embodiment disclosed above provides the same level of circuit protection as Underwriters Laboratories Fuse Standard Classes RK1, RK5, J, T. and CC. The installed footprint of the modular system is typically smaller than any of the above mentioned fuse classes for 600 volt AC performance.

In addition, the touch safe fuse system of the present invention provides protection to the international standard IEC 529 "Degrees of protection provided by enclosure (IP code)" at IP 20.

The casings for the fuse module 100 and fuse holder 102 can be made from a variety of high performance polymer materials using manufacturing processes such as injection molding. In addition, all live metal surfaces are now hidden and protected by the casings and thus the likelihood of accidental shock or short circuiting are greatly minimized. In addition, the need for spacing barriers between the prior art cylindrical fuses has now been eliminated. The resultant product is completely touch safe with regard to human contact in accordance with International Standard IEC 529 for a rating of IP 20 when installed in the IP 20 rated fuse base.

Figure 8:
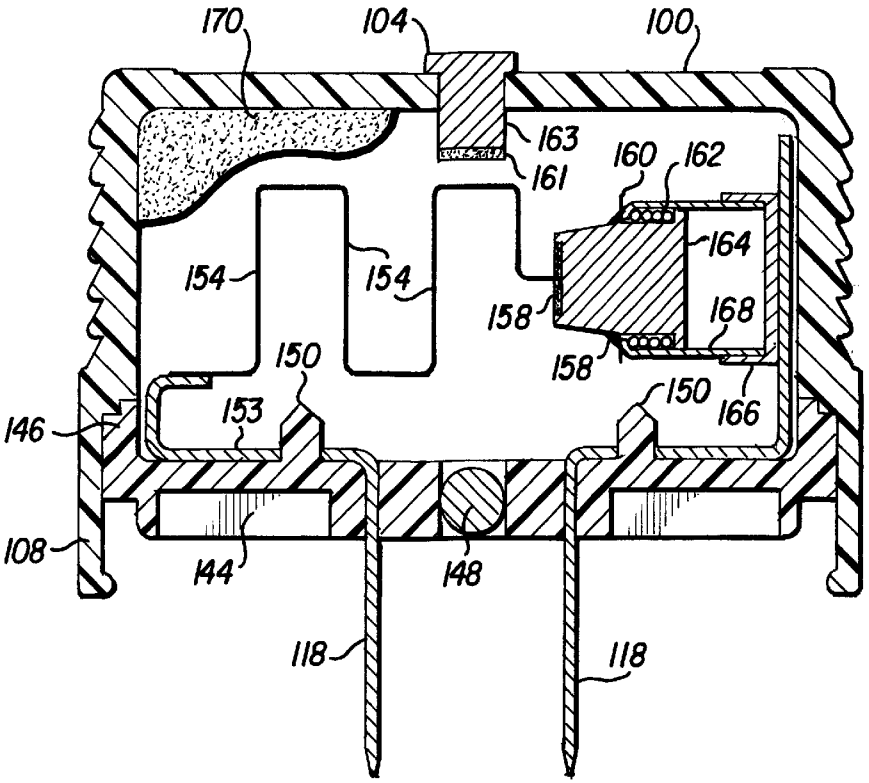
FIG. 8 is a cross-sectional view of the fuse of FIG. 1.

Turning attention to FIG. 8, a more detailed description of the blown fuse indicator 104 will now be provided. The blown fuse indicator includes a main body 163 that is preferably made from a clear or translucent material such as glass or plastic. The main body 163 is preferably substantially cylindrical in shape, although other shapes may be utilized without departing from the invention.

At one end of the main body 163, a flange may be provided to provide a surface that will secure the indicator in an opening in the casing of the fuse module 100. The main body 163 may be secured to the fuse module 100 with an adhesive, or simply by a friction fit.

At a bottom end of the main body 163 is provided a heat sensitive material 161 that will permanently change color upon exposure to a predetermined temperature. In one embodiment, the material 161 may be a piece of white paper that has a flash point of 260° C. Thus, if exposed to a temperature of 260° C. or greater, the white paper will turn black.

In another embodiment, the heat sensitive material 161 may be wax that is formulated to melt at a prescribed temperature, and that is opaque white in color. The wax is applied to the surface of a black absorbent material. In this form, the wax side of the absorbent material appears white. If the wax is then exposed to a temperature above the prescribed temperature, the wax will melt, will absorb the black material, and thus turn black.

Another embodiment uses a specific material made by Omega Engineering of Stamford, Conn. for the heat sensitive material 161. This product is sold under the name TL Series Labels, and includes various organic microcrystalline waxes, plastic films, and adhesives. The TS Series Labels may turn black when exposed to temperatures as low as 99° F.

As can be seen from FIG. 8, the main body 163 is secured to the fuse module 100 so that the main body 163 projects inwardly into the module 100 toward the fuse element 154. As a result, the heat sensitive material 161 is located very close to the fuse element 154, and will easily be exposed to a temperature sufficient to change the color thereof should the fuse element 154 overheat. The elongated body 163 acts as a light tube and enables an interested person to easily determine the color or condition of the heat sensitive material 161 from outside of the fuse module 100, even though the heat sensitive material 161 is located in a central portion of the fuse module 100.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A safety fuse comprising:

a casing having a bottom surface and opposing end surfaces at each longitudinal end of the bottom surface;

a fuse element extending longitudinally inside the casing, the fuse element having its respective ends adjacent the opposing end surfaces of the casing;

a pair of electrical contacts connected to the fuse element, the electrical contacts extending through openings in the bottom surface of the casing to an exterior of the casing;

the openings being located at a distance from the opposing end surfaces so that the electrical contacts are remote from the opposing end surfaces; and electrical connectors that extend longitudinally within the fuse casing and which connect the respective ends of the fuse element to the electrical contacts.

2. The safety fuse of claim 1, wherein the electrical contacts and the fuse element are electrically isolated from the fuse casing.

3. The safety fuse of claim 1, wherein the end surfaces include gripping elements.

4. The safety fuse of claim 1, wherein the electrical contacts are blade contacts.

5. A safety fuse comprising:

a casing having a bottom surface and opposing end surfaces at each longitudinal end of the bottom surface;

a fuse element extending longitudinally inside the casing, the fuse element having its respective ends adjacent the opposing end surfaces of the casing;

a pair of electrical contacts connected to the fuse element, the electrical contacts extending through openings in the bottom surface of the casing to an exterior of the casing;

the openings being located at a distance from the opposing end surfaces so that the electrical contacts are remote from the opposing end surfaces; and electrical connectors within the fuse casing that connect the respective ends of the fuse element to the electrical contacts;

wherein the electrical contacts extend substantially perpendicular to the bottom surface and the electrical connectors extend substantially parallel to the bottom surface.

6. The safety fuse of claim 5, wherein the openings and the electrical contacts are in a center portion of the bottom surface of the container.

7. The safety fuse of claim 1, wherein the fuse element includes a short circuit interruption element and an overload current interruption mechanism arranged in series.

8. The safety fuse of claim 1, wherein the fuse casing is substantially rectangular.

9. The safety fuse of claim 1, further comprising a light tube extending through the casing into an interior portion of the fuse and having an end at a location adjacent the fuse element, and a heat sensitive material fixed to the end, wherein the heat sensitive material turns a different color when exposed to a predetermined temperature.

10. A safety fuse system comprising:

a safety fuse including a fuse casing having a bottom surface and opposing end surfaces at each longitudinal end of the bottom surface; a fuse element extending longitudinally inside the fuse casing; a pair of electrical contacts connected to the fuse element, the electrical contacts extending through openings in the bottom surface of the fuse casing to an exterior of the fuse casing; the openings being located at a distance from the opposing end surfaces so that the electrical contacts are remote from the opposing ends; and electrical connectors that extend longitudinally within the fuse casing and that connect the fuse element to the electrical contacts;

a fuse holder including a fuse holder casing having a top surface, the top surface including apertures for receiving the electrical contacts of the safety fuse, the apertures being in alignment with the safety fuse openings when the safety fuse is engaged with the fuse holder;

metal contacts within the fuse holder casing for receiving the electrical contacts.

11. The safety fuse system of claim 10, wherein the fuse casing and the fuse holder casing are substantially rectangular.

12. The safety fuse system of claim 10, wherein the electrical contacts and the fuse element are electrically isolated from the fuse casing.

13. The safety fuse system of claim 10, further comprising dovetail slots on the fuse holder casing for interconnecting a plurality of fuse holder casings.

14. The safety fuse system of claim 10, further comprising a din rail connector on the fuse holder casing for attaching the fuse holder casing to a DIN rail.

15. The safety fuse system of claim 10, wherein the end surfaces include gripping elements.

16. The safety fuse system of claim 10, wherein the electrical contacts are blade contacts.

17. The safety fuse system of claim 10, the fuse element having its respective ends adjacent the opposing end surfaces of the casing, and further comprising electrical connectors within the fuse casing that connect the respective ends of the fuse element to the electrical contacts.

18. A safety fuse system comprising:

a safety fuse including a fuse casing having a bottom surface and opposing end surfaces at each longitudinal end of the bottom surface; a fuse element extending longitudinally inside the fuse casing; a pair of electrical contacts connected to the fuse element, the electrical contacts extending through openings in the bottom surface of the fuse casing to an exterior of the fuse casing; the openings being located at a distance from the opposing end surfaces so that the electrical contacts are remote from the opposing ends; and electrical connectors that connect the fuse element to the electrical contacts;

a fuse holder including a fuse holder casing having a top surface, the top surface including apertures for receiving the electrical contacts of the safety fuse, the apertures being in alignment with the safety fuse openings when the safety fuse is engaged with the fuse holder;

metal contacts within the fuse holder casing for receiving the electrical contacts;

wherein the openings and the electrical contacts are in a center portion of the bottom surface of the container.

19. The safety fuse system of claim 10, wherein the fuse element includes a short circuit interruption element and an overload current interruption mechanism arranged in series.

20. The safety fuse system of claim 10, further comprising a light tube extending through the casing into an interior portion of the fuse and having an end at a location adjacent the fuse element, and a heat sensitive material fixed to the end, wherein the heat sensitive material turns a different color when exposed to a predetermined temperature.

21. A safety fuse system comprising:

a safety fuse including a fuse casing having a bottom surface and opposing end surfaces at each longitudinal end of the bottom surface; a fuse element having a first and a second ends, and extending longitudinally inside the fuse casing; a pair of electrical contacts connected to the fuse element, the electrical contacts extending substantially perpendicular to the bottom surface through openings in the bottom surface of the fuse casing to an exterior of the fuse casing; the openings being located at a distance from the opposing end surfaces so that the electrical contacts are remote from the opposing ends; and electrical connectors that extend substantially parallel to the bottom surface and that connect the fuse element to the electrical contacts so that the first and the second ends of the fuse element are closer to the opposing end surfaces of the fuse casing than the electrical contacts;

a fuse holder including a fuse holder casing having a top surface, the top surface including apertures for receiving the electrical contacts of the safety fuse, the apertures being in alignment with the safety fuse openings when the safety fuse is engaged with the fuse holder;

metal contacts within the fuse holder casing for receiving the electrical contacts.

22. The safety fuse system of claim 21, wherein the electrical contacts are in a center portion of the bottom surface of the fuse casing.

* * * * *